US008894547B2

(12) United States Patent
Bruno

(10) Patent No.: US 8,894,547 B2
(45) Date of Patent: Nov. 25, 2014

(54) SYSTEM AND METHOD FOR EXERCISE BASED POWER GENERATION AND VIRTUAL CURRENCY REWARD PROGRAM

(76) Inventor: Daniel B. Bruno, Lewes, DE (US)

( * ) Notice: Subject to any disclaimer, the term of this patent is extended or adjusted under 35 U.S.C. 154(b) by 175 days.

(21) Appl. No.: 13/341,948

(22) Filed: Dec. 31, 2011

(65) Prior Publication Data

US 2013/0172150 A1 Jul. 4, 2013

(51) Int. Cl.
*A63B 24/00* (2006.01)

(52) U.S. Cl.
USPC ..... 482/2; 482/1; 482/8; 482/901

(58) Field of Classification Search
USPC ..... 482/1–9, 900–902; 434/247
See application file for complete search history.

(56) References Cited

U.S. PATENT DOCUMENTS

| | | | | | |
|---|---|---|---|---|---|
| 4,298,893 | A * | 11/1981 | Holmes | 348/730 |
| 4,512,566 | A * | 4/1985 | Bicocchi | 482/2 |
| 4,512,567 | A * | 4/1985 | Phillips | 463/37 |
| 4,542,897 | A * | 9/1985 | Melton et al. | 463/7 |
| 5,142,358 | A * | 8/1992 | Jason | 348/61 |
| 5,456,648 | A * | 10/1995 | Edinburg et al. | 482/4 |
| 2010/0125028 | A1* | 5/2010 | Heppert | 482/8 |
| 2012/0041767 | A1* | 2/2012 | Hoffman et al. | 705/1.1 |

* cited by examiner

*Primary Examiner* — Glenn Richman
(74) *Attorney, Agent, or Firm* — Maier & Maier, PLLC

(57) ABSTRACT

The present invention generally relates to power generation via fitness machines. Specifically, this invention relates to a system and method for generating power via the use and operation of fitness machines. Further, embodiments of the present invention are configured to utilize characteristics and/or data points associated with the use and operation of such fitness machines to calculate and reward users with one or more virtual currencies.

8 Claims, 10 Drawing Sheets

SYSTEM AND METHOD FOR EXERCISE BASED POWER GENERATION AND VIRTUAL CURRENCY REWARD PROGRAM

FIELD OF THE INVENTION

The present invention generally relates to power generation via fitness machines. Specifically, this invention relates to a system and method for generating power via the use and operation of fitness machines. Further, embodiments of the present invention are configured to utilize characteristics and/or data points associated with the use and operation of such fitness machines to calculate and reward users with one or more virtual currencies.

BACKGROUND OF THE INVENTION

Exercise and physical activity, being an important part of life, is engaged in by countless individuals every day. In modern athletics, it is commonplace to utilize one or more machines to engage in a workout routine. For instance, many individuals engage treadmills, elliptical machines, rowing machines, stair-climbing machines and stationary bikes to engage and improve their cardiovascular health. For individuals engaging their other muscular systems, individuals engage numerous weight lifting systems, typically comprised of systems of pulleys connected to variable weight settings.

The systems currently available in the art, particularly the cardiovascular machines, are powered by direct connection to a power supply (e.g., battery supply, AC power source) and are configured with a human machine interface (HMI) that provides basic data regarding the activity engaged in (e.g., calories burned, distance, speed, time) and potentially some information regarding the user (e.g., weight, heart rate, age).

While some embodiments of these machines require a reasonable amount of power to be provided to them in order to operate (e.g., treadmills), many of these machines require a relatively low amount of power to operate (e.g., stationary bikes, rowing machines) and in some instance, no power at all.

In machines that require little to no power, the user of the machine is typically pit against resistance created by an external force (e.g., electromagnetic resistance, cable resistance, friction resistance, gravity). In almost all cases, the user is expending energy to consistently work against these forces. For instance, a weightlifter utilizing a pulley operated system works against gravity to vertically lift weighted plates that are otherwise at rest.

One problem encountered with these machines is that energy expended is not harnessed. While these machines are frequently operated, their systems are configured only to allow the expended energy to be converted into a non-harnessed form. For instance, continuing from the example above, once the weightlifter has lifted the weighted plates off the ground utilizing the pulley operated system, the weightlifter simply lowers the weights back down to the ground with no harnessing of the expended energies.

Another limitation of exercise machines available in the art are that they typically lack any motivational capabilities that would inspire an individual to push their workout routine. This is apparent as most professional and home gyms have their exercise machines aligned with TVs or other simplistic entertainment device (e.g., radio, mp3 player).

Therefore, there is a need in the art for a system and method for generating power via the use and operation of a fitness machine. Further there is a need in the art for a system and method for motivating individuals to workout. These and other features and advantages of the present invention will be explained and will become obvious to one skilled in the art through the summary of the invention that follows.

SUMMARY OF THE INVENTION

Accordingly, it is an object of the present invention to provide a system and method for generating power via the use and operation of a fitness machine. Further, it is an object of certain embodiments of the present invention to provide a system and method for using and operating a fitness machine that encourages workouts through one or more rewards programs.

According to an embodiment of the present invention, the system is comprised of an exercise machine, a power generation source and a computing device.

According to an embodiment of the present invention, the exercise machine is a repetitive motion machine wherein difficulty in completing a motion is controlled by a resistance source. The resistance source is designed to allow increase or decrease the difficulty in completing a motion of the exercise machine.

According to an embodiment of the present invention, the exercise machine is coupled with the power generation source. The power generation source is configured to convert energy expended in completing a motion of the exercise machine into electrical current. In certain embodiments, the resistance source may be configured to allow the power generation source to generate greater or lesser amounts of electrical current based on the amount of resistance created.

According to an embodiment of the present invention, the system may be further comprised of a power storage component. The power storage component is configured to store excess power generated by the system for later use.

According to an embodiment of the present invention, the system may be further comprised of a human machine interface (HMI). The HMI is configured to provide the user with metrics and other data regarding exercise on the machine and other information related to the user.

According to an embodiment of the present invention, the computing device is configured to calculate information and metrics regarding exercise on the machine and other information related to the user.

According to an embodiment of the present invention, the computing device is configured to provide one or more rewards programs to the user of an exercise machine. The rewards program may be based on one or more characteristics of the exercise, the user or any combination thereof.

According to an embodiment of the present invention, the computing device may be comprised of a communications module configured to allow the computing device to communicate with one or more remote computing devices. The communications module may be utilized to validate and otherwise participate in certain rewards programs.

According to an embodiment of the present invention, the rewards programs may be utilized to generate one or more virtual currencies. Generation of such virtual currencies may be based on one or more characteristics related to the system or the user.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

Presently preferred embodiments are shown in the drawings. It should be appreciated, however, that the invention is not limited to the precise arrangements and instrumentalities shown.

DETAILED SPECIFICATION

Figure 1:
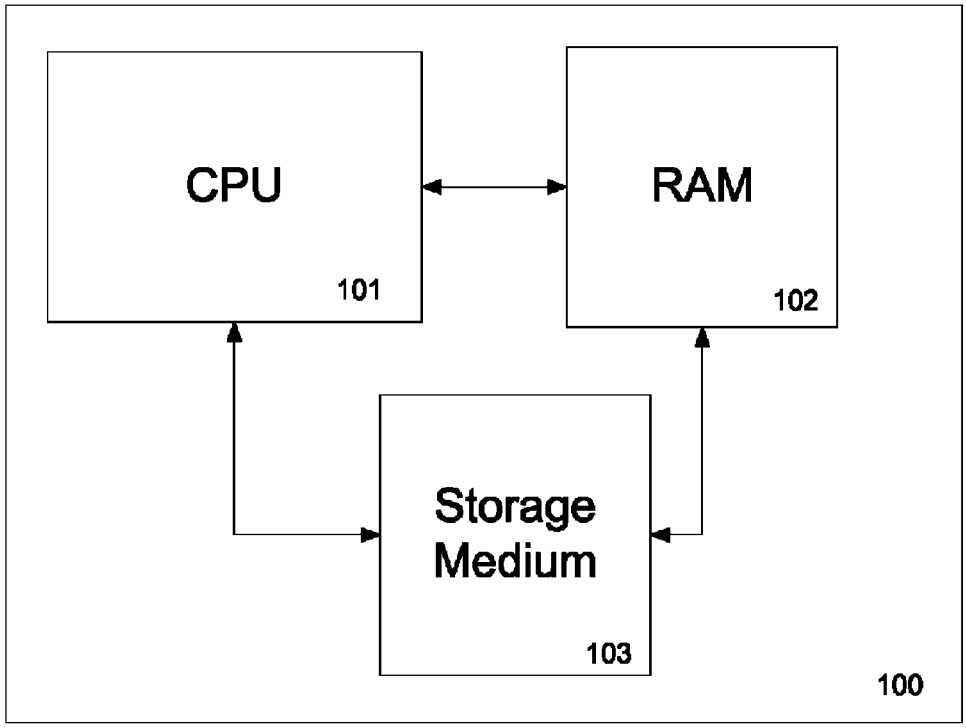
FIG. 1 illustrates a schematic overview of a computing device, in accordance with an embodiment of the present invention.

The present invention generally relates to power generation via fitness machines. Specifically, this invention relates to a system and method for generating power via the use and operation of fitness machines. Further, embodiments of the present invention are configured to utilize characteristics and/or data points associated with the use and operation of such fitness machines to calculate and reward users with one or more virtual currencies.

According to an embodiment of the present invention, the system is comprised of an exercise machine, a power generation source and a computing device. In a preferred embodiment, the exercise machine, power generation source and computing device are integrated as a single device and operated in unison. In alternate embodiments, one or more of the power generation source, computing device and other components may be integrated into a standard exercise machine.

According to an embodiment of the present invention, the exercise machine comprises a repetitive motion machine wherein difficulty in completing a motion is controlled by a resistance source. Repetitive motion machines include, but are not limited to, rowing machines, weightlifting machines, stationary bikes, treadmills, stair-climbing machines and elliptical machines. One of ordinary skill in the art would appreciate that there are numerous repetitive motion machines that could be utilized in embodiments of the present invention, and embodiments of the present invention are contemplated for use with any repetitive motion machine.

The resistance source is designed to allow increase or decrease the difficulty in completing a motion of the exercise machine. Resistance sources may include, but are not limited to, one or more of a cable resistance source, pulley resistance source, geared resistance source, a roller resistance source and a pneumatic resistance source. One of ordinary skill in the art would appreciate that there are numerous resistance sources that could be utilized with embodiments of the present invention and embodiments of the present invention are contemplated for use with any resistance source.

In a preferred embodiment, the resistance source is an integrated portion of the power generation source. For instance, the resistance source may be a portion of a belt or roller generator that generates electricity by turning a generator in a rotary motion. In this embodiment, the resistance source may be further comprised of a multi-geared resistance schema, whereby changing the gear ratios will increase the resistance felt by the user utilizing the exercise machine while at the same time allowing the generator to spin faster and generate greater amounts of electricity, even where the revolutions/repetitions per minute of the exercise machine decrease. Conversely, as the user decreases the resistance, the ratio lowers, lowering the amount of electricity generated by each revolution/repetition of the exercise machine.

In certain embodiments, the resistance may not have variable settings. In these embodiments, the system will only have one set resistance and power generation will be dependent solely on the number of revolutions or repetitions performed by the user. These embodiments are typically simpler to create as no special gearing or resistance changing source is required.

According to an embodiment of the present invention, the exercise machine is coupled with the power generation source. The power generation source is configured to convert energy expended in completing a motion of the exercise machine into electrical current. The amount of power that will be generated depends on many factors, including type of exercise machine used, which muscle groups are engaged and the endurance/strength of the user. For instance, exercise machines using only the arms may be able to generally generate between 10 and 100 watts, with greater values achievable by users who are athletic or possess other physical prowess. Exercise machines that utilize leg muscles may be able to generally generate between 300 to 1000 watts, with greater values achievable by users who are athletic or possess other physical prowess. The aforementioned power generation statistics are provided for example purposes only and amounts greater or less than the above amounts may be achievable when utilizing more or less efficient generators. One of ordinary skill in the art would appreciate that there are numerous types of generators that may be utilized with embodiments of the present invention, and embodiments of the present invention are contemplated for use with any type of generators.

According to an embodiment of the present invention, the system may be further comprised of a power storage component. The power storage component is configured to store excess power generated by the system for later use. The power storage component may be directly connected to the power generator or connected via one or more routing systems, such as an alternator that sends excess power above the power needs of the exercise machine to the power storage component. Power storage components may include, but are not limited to, batteries and capacitors. One of ordinary skill in the art would appreciate that there are numerous types of power storage components and routing systems that may be utilized with embodiments of the present invention, and embodiments of the present invention are contemplated for use with any type of power storage component and/or routing system.

In certain embodiments, multiple embodiments of the system may be linked together in order to create a collective power generation and storage source. For instance, a plurality of exercise machines with power generation systems may be linked together with a single power storage component. In this manner, through group exercise, a significant source of power generation may be achieved. One example would be through the use of spin classes conducted at gyms, where groups of individuals, sometimes in excess of 30-50 individuals utilize stationary bikes for lengthy periods of time (e.g., 1 hour or more). With a single individual generating approximately 500 watts, a class of 50 individuals could produce 25 kW. Even after deducting the power used to operate the system, a significant amount of excess energy could be produced and stored (e.g., 5-20 kW).

According to an embodiment of the present invention, the system may be further comprised of a human machine interface (HMI). The HMI is configured to provide the user with metrics and other data regarding exercise on the machine and other information related to the user. The HMI may be similar to those found on exercise machines currently available in the art and are configured to display metrics and data points that users typically find useful (e.g., calories burned, time, distance, number of completed repetitions, weight, heart rate). One of ordinary skill in the art would appreciate that there are numerous metrics and data points that may be utilized in accordance with embodiments of the present invention, and embodiments of the present invention are contemplated for use with any such metrics and/or data points.

In a preferred embodiment, the HMI comprises a display screen and a tactile interface for use by the user. The display screen is configured to provide useful data to the user in a visual representation. The tactile interface is configured to receive inputs from the user in order to change or enter information or settings useable by the exercise machine. Display screens may include, but are not limited to, LED screens, LCD screens, projectors, AMOLED screens, CRT screens and plasma screens. Tactile interfaces may include, but are not limited to, push buttons, touch screens, switches and knobs. In certain embodiments, the display screen and tactile interface may be one integrated component (e.g., touch screen). One of ordinary skill in the art would appreciate that there are numerous types of display screens and tactile interfaces that may be utilized by embodiments of the present invention, and embodiments of the present invention are contemplated for use with any type of display screen and/or tactile interface.

In certain embodiments of the present invention, the HMI may be integrated within the computing device utilized by the system. In this manner, the system is configured to provide data to the computing device which the computing device then utilizes to compute and display the various useful data elements to the user.

One of ordinary skill in the art would appreciate that a computing device (FIG. 1) appropriate for use with embodiments of the present application may generally be comprised of one or more of a Central processing Unit (CPU), Random Access Memory (RAM), and a storage medium (e.g., hard disk drive, solid state drive, flash memory). Examples of computing devices usable with embodiments of the present invention include, but are not limited to, personal computers, smart phones, laptops, mobile computing devices, and servers. One of ordinary skill in the art would understand that any number of computing devices could be used, and embodiments of the present invention are contemplated for use with any computing device.

According to an embodiment of the present invention, the computing device is configured to calculate information and metrics regarding exercise on the machine and other information related to the user. Information and metrics may include, but are not limited to, heart rate, calories burned, time elapsed, time remaining, heart rate zone, watts produced, watts consumed by system, excess watts, body fat percentage, weight, rewards earned and upcoming rewards. One of ordinary skill in the art would appreciate that there are numerous types of metrics and information that may be calculated and utilized by embodiments of the present invention, and embodiments of the present invention are contemplated for use with any type of information or metric.

According to an embodiment of the present invention, the computing device is configured to provide one or more rewards programs to the user of an exercise machine. The rewards program may be based on one or more characteristics of the exercise, the user or any combination thereof. For instance, the system may provide a reward program that rewards a user with specific or variable amounts of a virtual currency based on one or more formulas incorporating one or more aspects of the individual, exercise program and goals. In a simple example, the system may be configured to provide a user with one unit of a virtual currency for each predetermined length of exercise (e.g., 10 minutes).

In more complex methods, the rewards may be based on complex calculations based on numerous elements. For instance, a complex calculation may consist of rewarding a user with one or more units of virtual currency after achieving a specified metric (e.g., watts output) within a specified amount of time (e.g., under 5 minutes) with the specified metric being calculated based on characteristics of the individual (e.g., body fat percentage, age, weight, fitness goals). In this manner, the system can be configured to provide rewards either on a lock step basis or on a variable basis.

Further, the system may be configured to utilize the computing device to calculate the creation/reward of virtual currency based on algorithms which utilize one or more aspects to generate the virtual currency. Creation/rewarding of virtual currency may be done based on the amount of electricity generated by the user utilizing the exercise machine, whether bases solely on excess power generation (i.e., power generated above the amount required to run the system) or total power generation, or based upon other data points. For instance, randomized or solution based algorithms may be utilized to generate the virtual currency based upon certain occurrences (e.g., the appearance of a random number, solving a hash). One of ordinary skill in the art would appreciate that there are numerous algorithms that could be utilized with embodiments of the present invention, and embodiments of the present invention are contemplated for use with any appropriate algorithm.

According to an embodiment of the present invention, the computing device may be comprised of a communications module configured to allow the computing device to communicate with one or more remote computing devices. Communications modules may utilize one or more types of wired (e.g., Ethernet) and/or wireless (e.g., CDMA, GSM, WiFi) forms of communications. Communications modules may be configured to both transmit and receive data from various sources (e.g., Wide Area Networks (WAN), Local Area Networks (LAN), the Internet). One of ordinary skill in the art would appreciate that there are numerous types of communications modules that may be utilized with embodiments of the present invention, and embodiments of the present invention are contemplated for use with any form of communications module.

According to an embodiment of the present invention, the communications module may be utilized to validate and otherwise participate in certain rewards programs. In this manner, the rewards programs are controlled and conducted on one or more remote computing devices. This allows for rewards programs to be executed and controlled at a distant location. One advantage of having rewards programs conducted remotely is the ability to prevent fraud and maintain unity in rewards across multiple exercise locations. Access to and enrollment into such remotely controlled rewards programs may require login and signup by the user (e.g., registration online). One of ordinary skill in the art would appreciate that there are numerous ways to handle a registration process, and embodiments of the present invention are contemplated for use with any such method for registering users. In this manner, information regarding the user may be stored, tracked and utilized further by the system. For instance, the system may track fitness goals of the user over time (e.g., weight loss, fat loss, improvement in workouts).

In alternate embodiments, the rewards programs may be controlled and conducted locally at the exercise machine or at a facility containing the exercise machine. In these embodiments, the rewards programs may be executed by a single entity. In further embodiments, the rewards programs may be controlled and conducted locally, but later synchronized with remote rewards program systems. This may be achieved by the use of batch processing or the like.

Exemplary Embodiments

Figure 2:
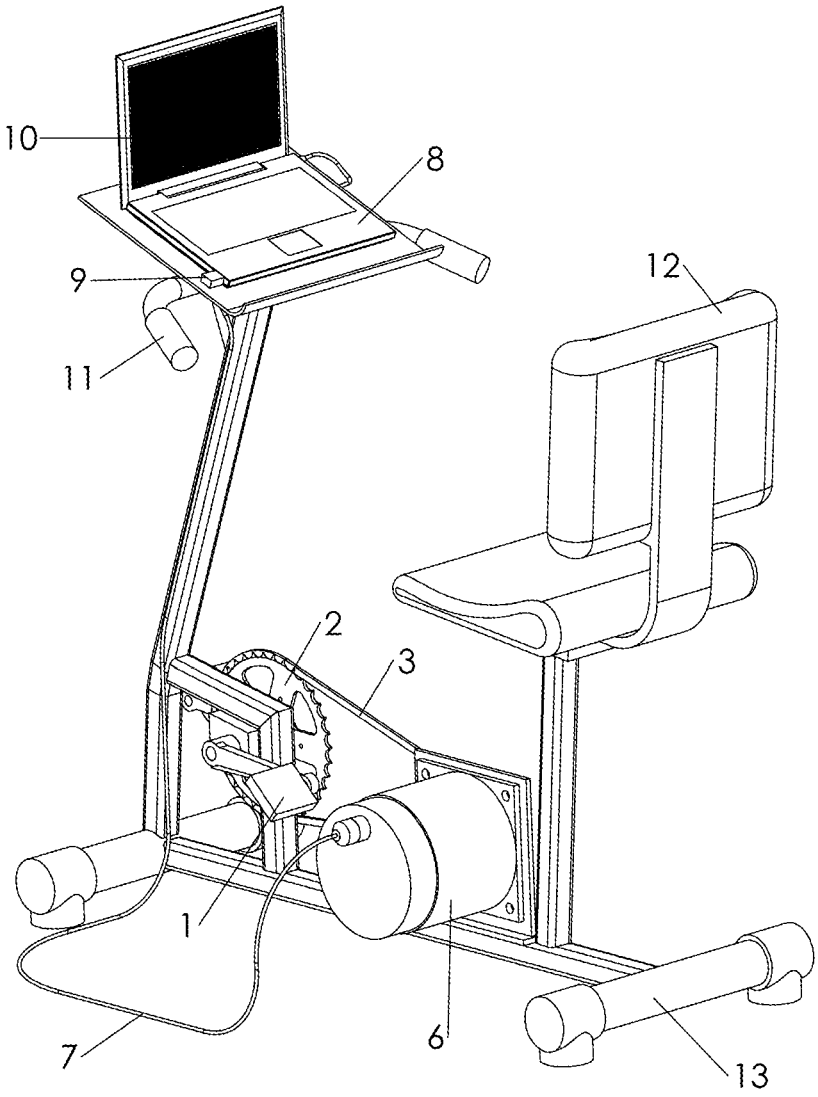
FIG. 2 illustrates a perspective view of a power generating exercise machine, in accordance with an embodiment of the present invention.
Figure 3:
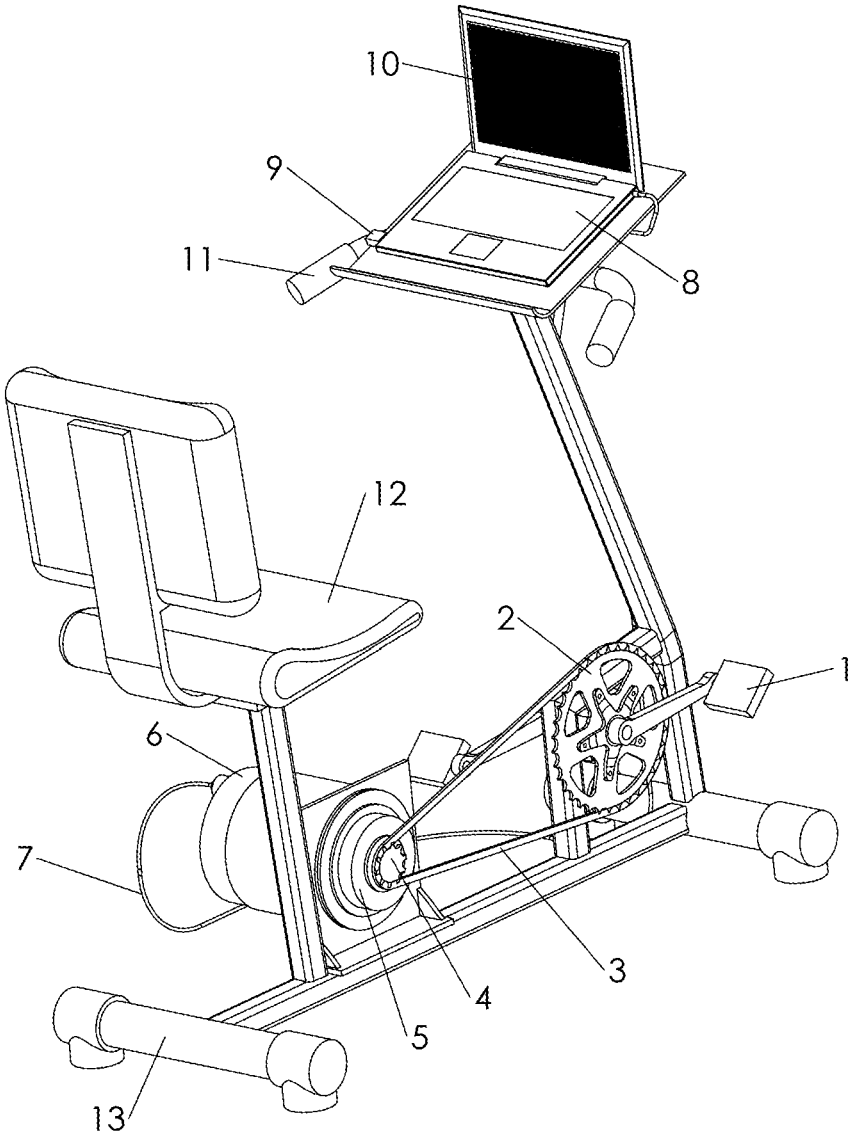
FIG. 3 illustrates a perspective view of a power generating exercise machine, in accordance with an embodiment of the present invention.

Turning now to FIGS. 2-3, an exemplary embodiment of an exercise machine in accordance with the present invention is shown. In this embodiment, a stationary bike is shown, comprising one or more pedals 1, a drive gear 2, a drive chain 3, generator gear 4, roller power generator component 5, power generator 6, electrical cable 7, computing device 8, computing device stand 9, display screen 10, handle bars 11, seating area 12 and one or more stabilizing bars 13. In the specific drawing, two pedals 1 are connected to drive gear 2 in such a manner that when the two pedals 1 are operated, drive gear 2 is turned, which in turn operates drive chain 3. Operation of drive chain 3 turns generator gear 4 which is attached to and affects the turning of roller power generator component 5, generating power in power generator 6. Generated power is transferred by electrical cable 7 to the computing device 8. This power is utilized to operate computing device 8 which is retained upon computing device stand 9. Power is further utilized to operate display screen 10 which is an integrated component of computing device 9. Handle bars 11 are optional and may be utilized by a user to help stabilize or balance during a workout routine. Seating area 12 is configured to retain a user during a workout and stabilizing bars 13 are configured to provide a stable base for the exercise machine and prevent tipping.

Figure 4:
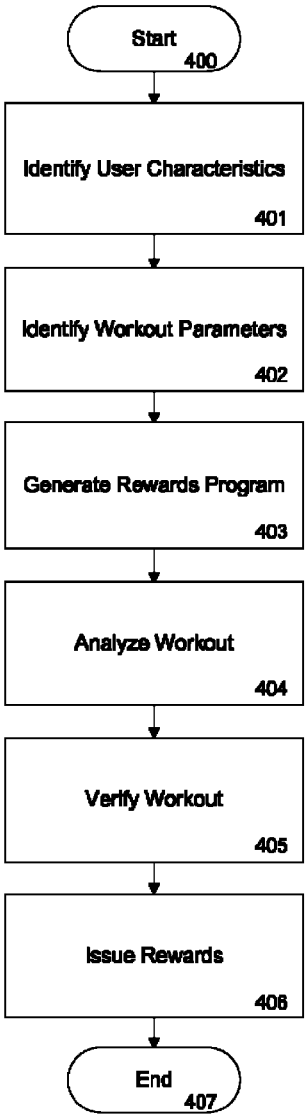
FIG. 4 illustrates a flowchart for an exemplary method associated with analyzing a degree of difficulty of an exercise, in accordance with an embodiment of the present invention.
Figure 5:
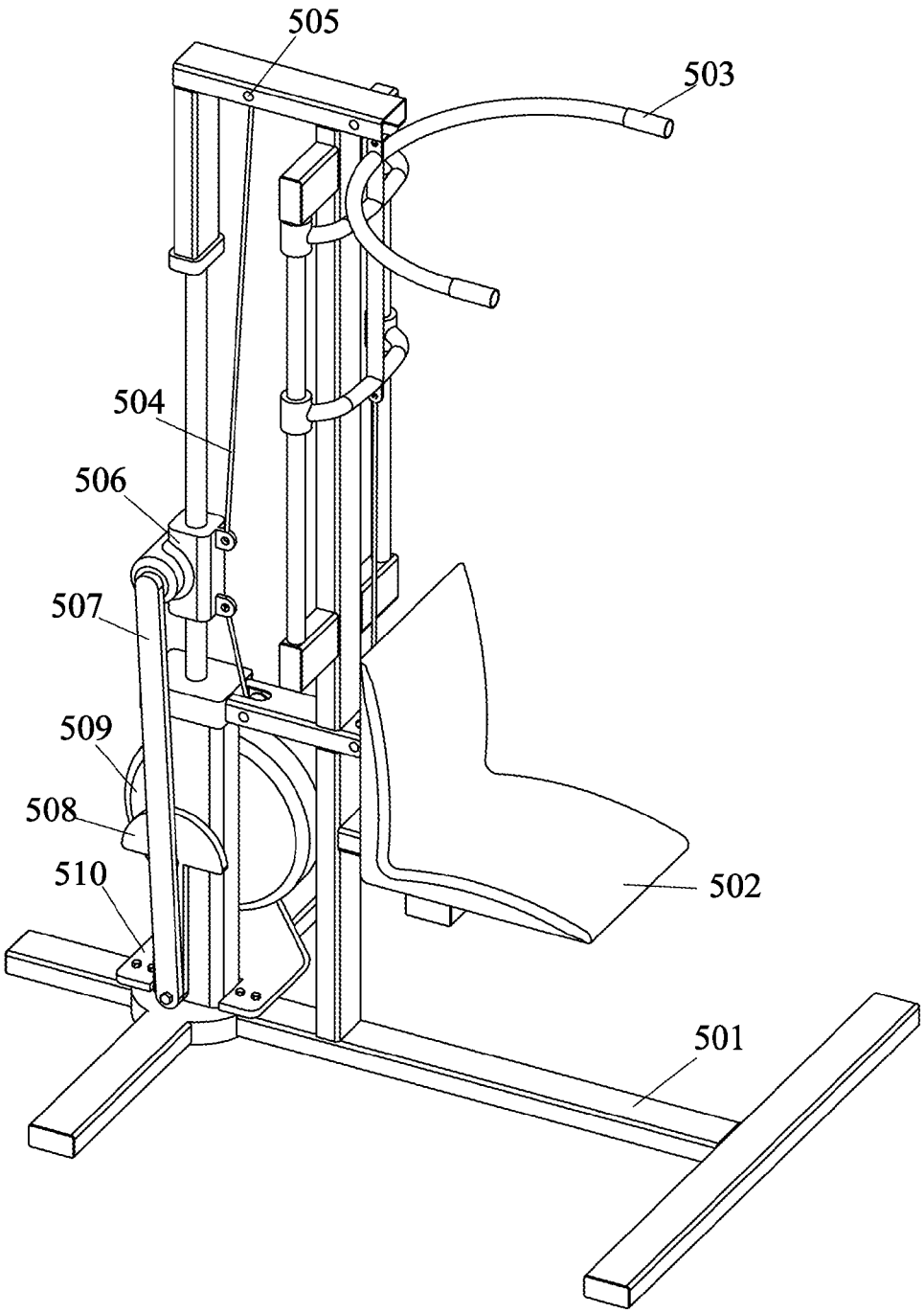
FIG. 5 illustrates a perspective view of a power generating exercise machine, in accordance with an embodiment of the present invention.
Figure 6:
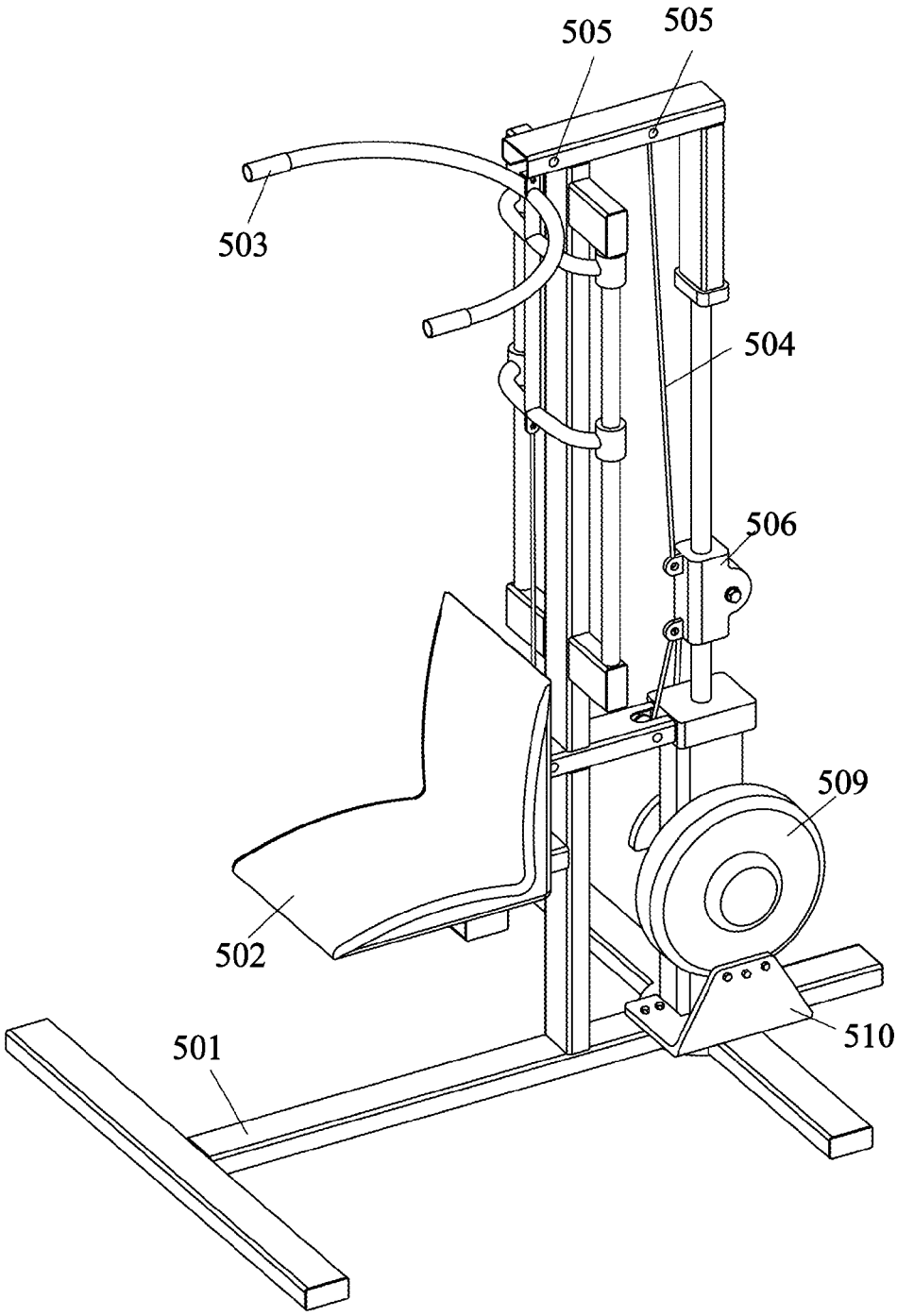
FIG. 6 illustrates a perspective view of a power generating exercise machine, in accordance with an embodiment of the present invention.
Figure 7:
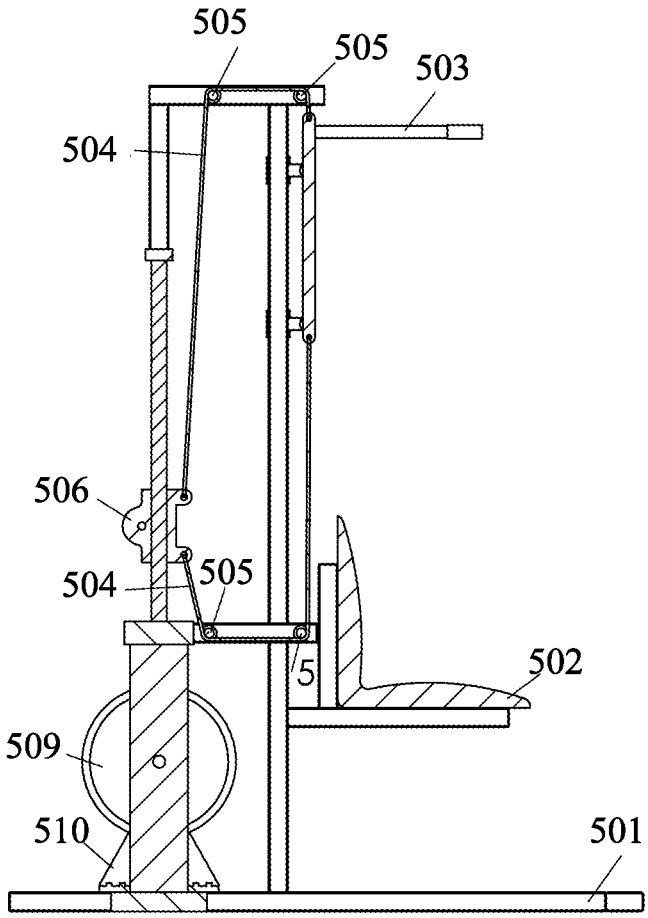
FIG. 7 illustrates a side view of a power generating exercise machine, in accordance with an embodiment of the present invention.
Figure 8:
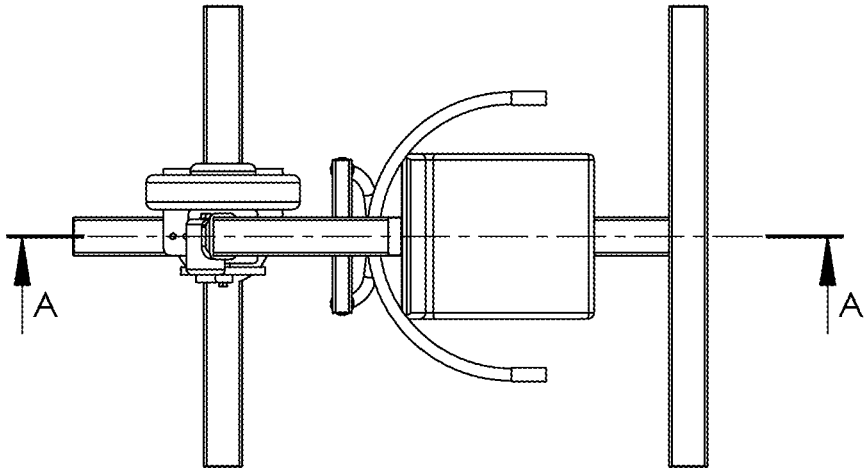
FIG. 8 illustrates a top view of a power generating exercise machine, in accordance with an embodiment of the present invention.
Figure 9:
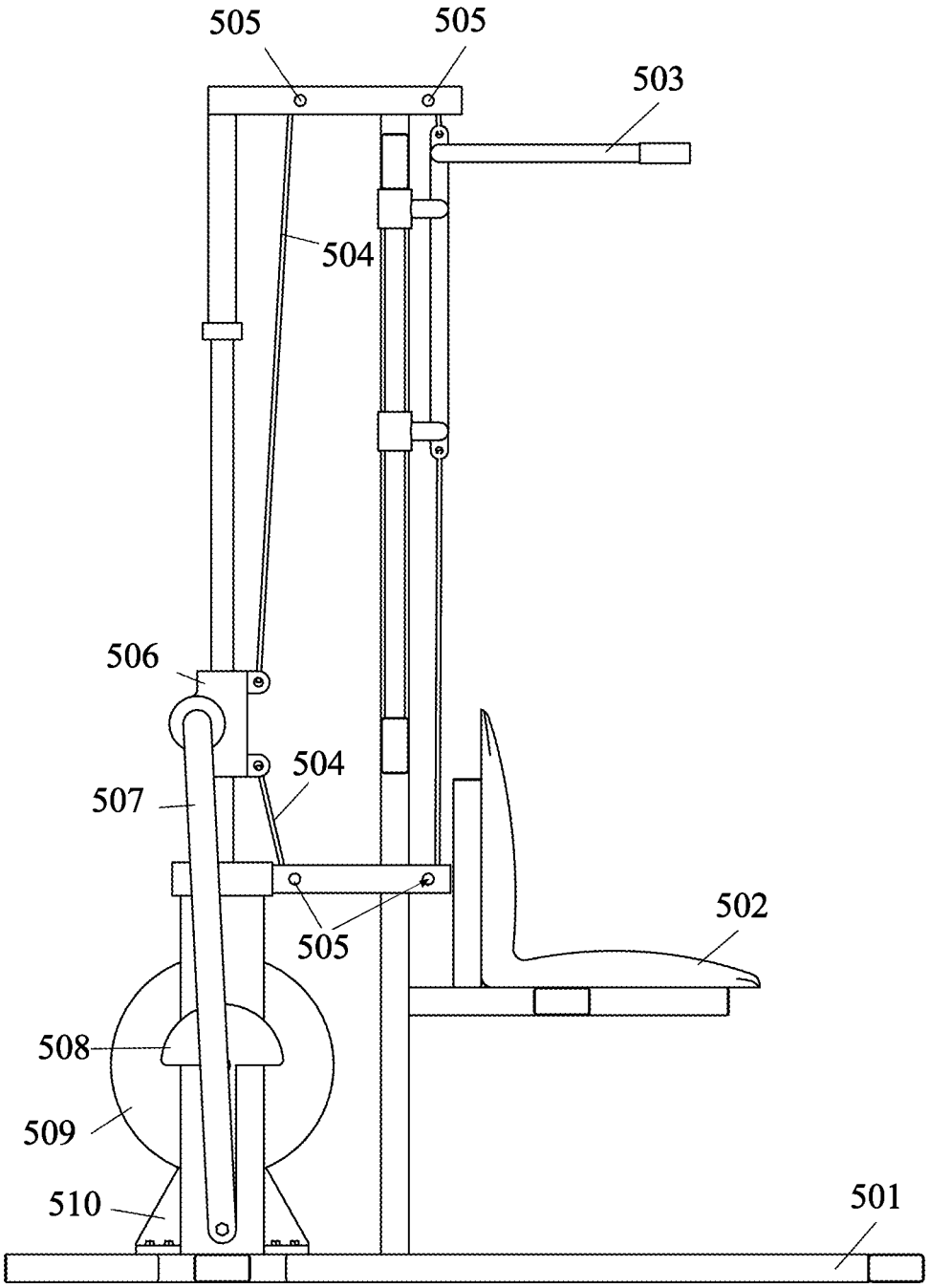
FIG. 9 illustrates a side view of a power generating exercise machine, in accordance with an embodiment of the present invention.
Figure 10:
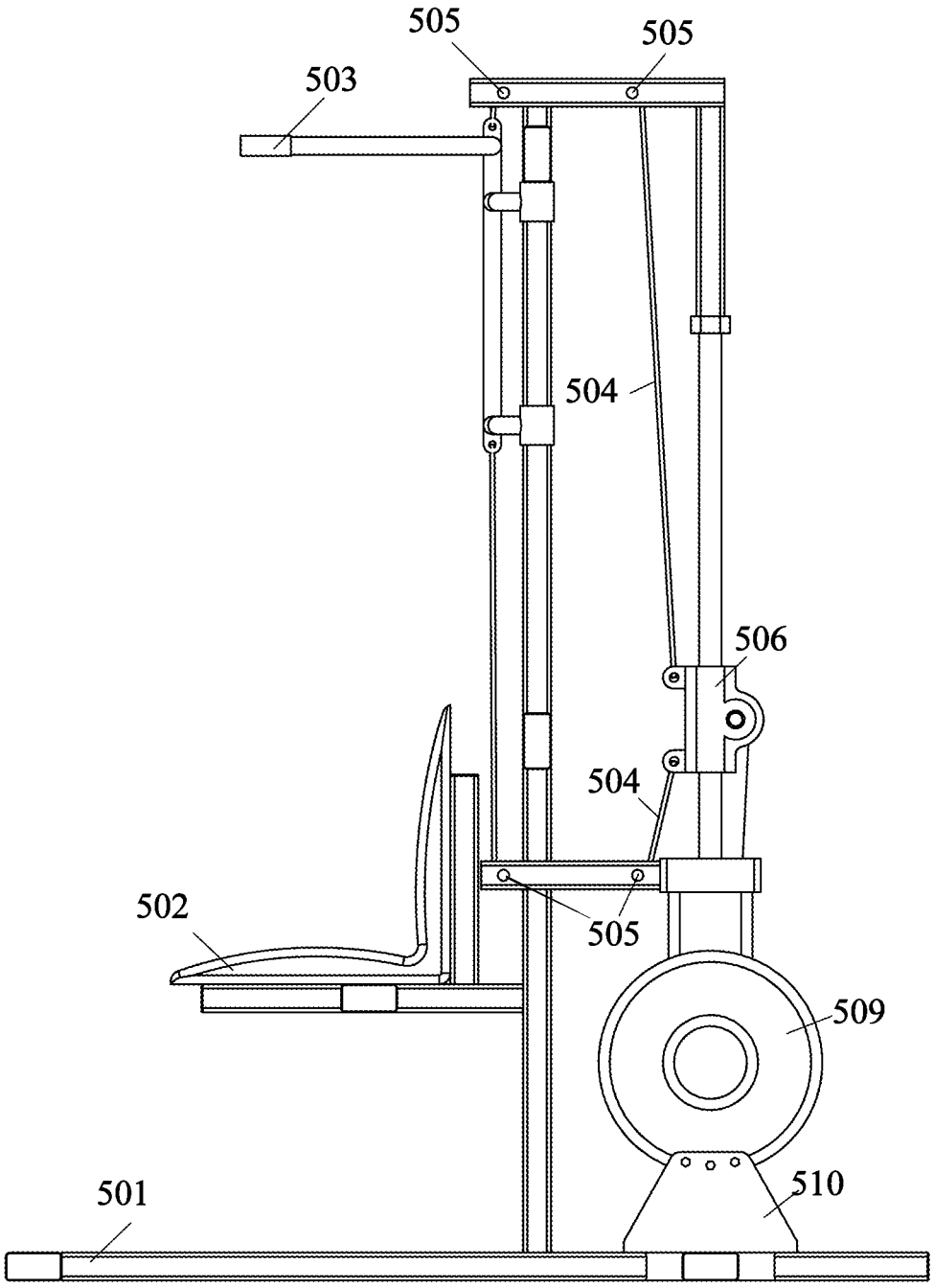
FIG. 10 illustrates a side view of a power generating exercise machine, in accordance with an embodiment of the present invention.
Figure 11:
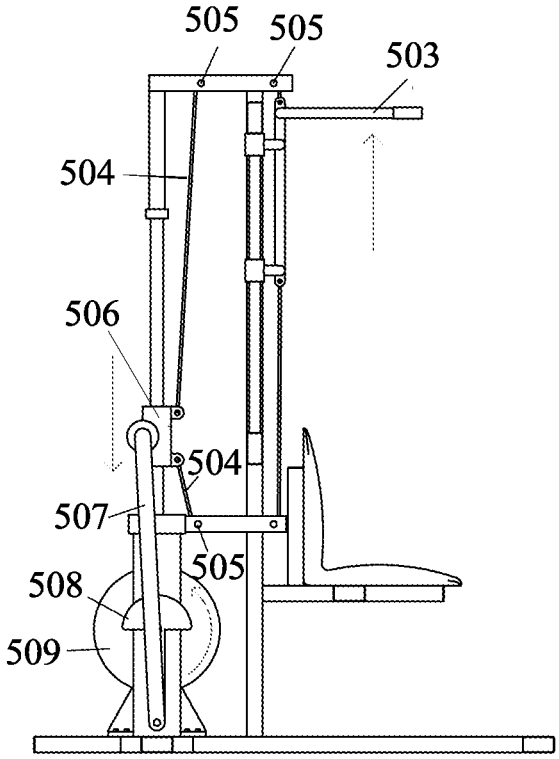
FIG. 11 illustrates a side view of a power generating exercise machine, in accordance with an embodiment of the present invention.
Figure 12:
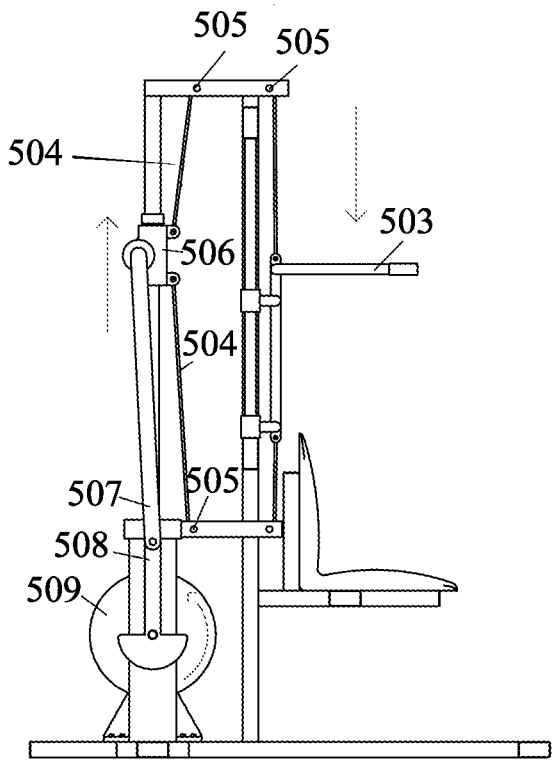
FIG. 12 illustrates a side view of a power generating exercise machine, in accordance with an embodiment of the present invention.

Turning now to FIG. 4, an exemplary method in accordance with the present invention is shown. The process starts at step 400, when a user first wishes to utilize the system described herein. At step 401, the system identifies characteristics of the individual. These may be entered by the user (e.g., age, weight, body fat percentage, name, user name, identification, password) or automatically identified by the system (e.g., weight, body fat percentage, personal information identified by user's account information).

At step 402, the system identifies the parameters of the workout. Workout parameters may be entered into the system by the user (e.g., duration, distance, weight, repetitions) or automatically generated by the system (e.g., preconfigured workout routines). Further, the system may be configured to generate dynamic workout routines based on one or more user goals (e.g., I want to generate 3 units of virtual currency).

At step 403, the system utilized the information provided in steps 401 and 402 to generate an appropriate rewards program for the user and the selected workout parameters. To perform this action, the system may be required to query and receive information from one or more remote computing devices to obtain valid rewards programs and verify the user's ability to participate in such rewards programs.

At step 404, the workout is performed by the user, with the system tracking progress and other metrics associated with the workout. The system may be configured to display to the user his/her exact progress and other metrics associated with the workout. The system may be further configured to offer motivational support to the user in order to push the user's workout. For instance, the system may randomly present the user to earn more virtual currency by performing on the spot goals (e.g., perform a specified number of revolutions within the next minute to earn an additional unit of virtual currency).

At step 405, the user has completed his/her workout and the system verifies the workout and any earned virtual currency units. This may be done locally or in conjunction with one or more remote computing devices in order to eliminate the possibility of spoofing or otherwise gaming the system for rewards not earned.

At step 406, the system issues the rewards to the user. The rewards may be stored remotely for use anywhere the virtual currency is accepted or locally for use at the specific site (e.g., at the user's gym). In certain embodiments, the user may be able to utilize the system or other computing device to review the rewards (e.g., check balance, review transactions).

The process terminates at step 207. The steps herein provided are for example purposes only and may be executed in numerous alternate orderings.

Turning now to FIGS. 5-12, alternate exemplary embodiments of weightlifting machines configured to generate power during operation, in accordance with embodiments of the present invention, are shown. These embodiments are configured to generate power upon every repetition executed on the machine. As the resistance is increased, more power may be generated. Exemplary embodiments, as shown in these figures, are comprised of a base structure 501, a seat 502, a handle bar 503, one or more cables 504, one or more wheels 505, one or more motion changers 506, one or more crank arms 507, one or more rotors 508 and one or more generators 509 which are held in place or mounted to base structure 501 by a generator mount 510.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

I claim:

1. A computer implemented method for measuring the work performed associated with a workout and allocating value to a reward in the form of a unit of virtual currency based upon the measurement of power generated during said workout, comprising the steps of:

identifying, with a computing device, one or more characteristics associated with a user;

identifying, with a computing device, one or more parameters associated with said workout;

generating, with said computing device, said reward in the form of a unit of virtual currency based on said one or more characteristics and one or more parameters;

utilizing an exercise machine to achieve said workout, wherein said exercise machine is configured to generate electrical power during said workout;

analyzing said workout;

analyzing the measurement of said electrical power generated during said workout; verifying said workout meets said one or more parameters associated with said workout; allocating value to a said reward in the form of a unit of virtual currency based upon analysis of electrical power generated during said workout, and; issuing one or more rewards in the form of units of virtual currency valued based upon analysis of electrical power generated during said workout.

2. The method of claim 1, wherein said exercise machine is a stationary bike.

3. The method of claim 1, wherein said exercise machine is an elliptical machine.

4. The method of claim 1, wherein said exercise machine is a rowing machine.

5. The method of claim 1, wherein said exercise machine is a weightlifting machine.

6. The method of claim 1, further comprising the steps of generating one or more units of virtual currency valued based upon analysis of said workout and then allocating the units of virtual currency to the person performing said workout.

7. The method of claim 1, wherein the generation of one or more units of virtual currency valued based upon analysis of said workout as rewards is further based upon the use of algorithmic function.

8. The method of claim 1, further comprising the step of storing a record of units of virtual currency valued based upon analysis of said workout on one or more remote computing devices.

* * * * *